US009592521B2

(12) United States Patent
Wilson et al.

(10) Patent No.: US 9,592,521 B2
(45) Date of Patent: Mar. 14, 2017

(54) DRAIN WAND

(71) Applicants: William Wilson, Orlando, FL (US); Lisa Wilson, Orlando, FL (US)

(72) Inventors: William Wilson, Orlando, FL (US); Lisa Wilson, Orlando, FL (US)

( * ) Notice: Subject to any disclaimer, the term of this patent is extended or adjusted under 35 U.S.C. 154(b) by 0 days.

(21) Appl. No.: 14/616,241

(22) Filed: Feb. 6, 2015

(65) Prior Publication Data

US 2016/0228930 A1 Aug. 11, 2016

(51) Int. Cl.

| | |
|---|---|
| ***B05B 9/01*** | (2006.01) |
| ***B05B 15/06*** | (2006.01) |
| ***B05B 13/06*** | (2006.01) |
| ***B08B 9/00*** | (2006.01) |
| ***B08B 9/043*** | (2006.01) |
| ***E03C 1/306*** | (2006.01) |

(52) U.S. Cl.

CPC ..... *B05B 15/061* (2013.01); *B05B 9/01* (2013.01); *B05B 13/0627* (2013.01); *B08B 9/00* (2013.01); *B08B 9/0433* (2013.01); *E03C 1/306* (2013.01)

(58) Field of Classification Search

CPC ... B08B 9/093; B05B 13/0627; B05B 15/061; B05B 9/01; E03D 5/00

USPC ..... 239/532, 750, 280, 282

See application file for complete search history.

(56) References Cited

U.S. PATENT DOCUMENTS

| | | | | |
|---|---|---|---|---|
| 5,884,842 | A * | 3/1999 | Caine | B05B 15/001 134/167 R |
| 5,964,419 | A * | 10/1999 | Lovett | B05B 1/20 239/532 |
| 6,079,640 | A * | 6/2000 | Merritts | B05B 1/20 239/532 |
| 6,247,658 | B1 * | 6/2001 | Bakas | B08B 3/026 134/123 |
| 6,378,791 | B1 * | 4/2002 | Perry | B05B 1/20 239/280 |
| 7,806,351 | B1 * | 10/2010 | Bakas | B05B 9/01 239/195 |

* cited by examiner

*Primary Examiner* — Arthur O Hall
*Assistant Examiner* — Chee-Chong Lee
(74) *Attorney, Agent, or Firm* — Jason T. Daniel, Esq.; Daniel Law Offices, P.A.

(57) ABSTRACT

A drain wand includes an elongated wand body having an outside diameter of approximately ¼ inches. The wand body includes a first end that houses a water inlet unit and a valve controller. A sprayer is disposed along the second end of the elongated wand and is connected to the inlet unit and controller via an internal channel. The sprayer includes an elongated longitudinal opening that functions to discharge water at a generally perpendicular angle to the wand and at approximately 125 psi.

1 Claim, 4 Drawing Sheets

DRAIN WAND

TECHNICAL FIELD

The present invention relates generally to sanitation devices, and more particularly to a drain wand for cleaning floor drains.

BACKGROUND

The statements in this section merely provide background information related to the present disclosure and may not constitute prior art.

Floor drains are installed in both commercial and residential structures where water is likely to accumulate. Most commonly, floor drains are installed at locations such as bathrooms and basements, for example, and function to prevent water from damaging the building structure.

In addition to the above, floor drains are also commonly located within commercial kitchens, and allow the floors to be easily rinsed and cleaned after food service has been completed. During the cleaning process, it is not uncommon for food particles and other gelatinous materials to pass through the drain grates, and to accumulate within the drain body. Over time, this accumulation of material can become a breeding ground for insects such as flies, gnats and roaches, for example. As a result, regular cleaning of floor drains is necessary to maintain a clean and safe environment.

In most instances, floor drains are cleaned by removing the screws that hold the drain grate in place, and then utilizing a pressure washer to clean the drain pipes. Unfortunately, these screws have a tendency to break or become stripped over time, thus preventing easy access to the drain body. Moreover, the utilization of high pressure water has two serious drawbacks. First, when high pressure water is sprayed into the drain, much of the offending material is splashed back out, into the surrounding area. When this occurs, the user must expend additional time and effort to clean the mess caused by the drain cleaning itself. Additionally, pressure washers have a typical output that is between 1,000 psi and 5,000 psi. When utilized on the plastic/PVC drains, this high pressure spray can easily crack the (often) brittle drain member. When a drain crack occurs, it then becomes necessary to hire a plumber or other such professional to repair the drain, thereby resulting in a large repair bill.

Accordingly, it would be beneficial to provide a drain wand that is specifically designed to clean building drains with a pressure that will not cause damage to the drain member, and that does not require a user to remove the drain grate.

SUMMARY OF THE INVENTION

The present invention is directed to a drain wand. One embodiment of the present invention can include an elongated wand body having a small diameter that can be positioned through the grate openings of a floor drain. The wand body can include a first end that houses a water inlet unit and a valve controller. A sprayer is disposed along the second end of the elongated wand and is connected to the inlet unit and controller via an internal channel. The sprayer can include an elongated longitudinal opening that functions to discharge water at a generally perpendicular angle to the wand and at approximately 125 psi.

Another embodiment of the present invention can include a generally blunt end that functions to scrape material from the walls of a building drain.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
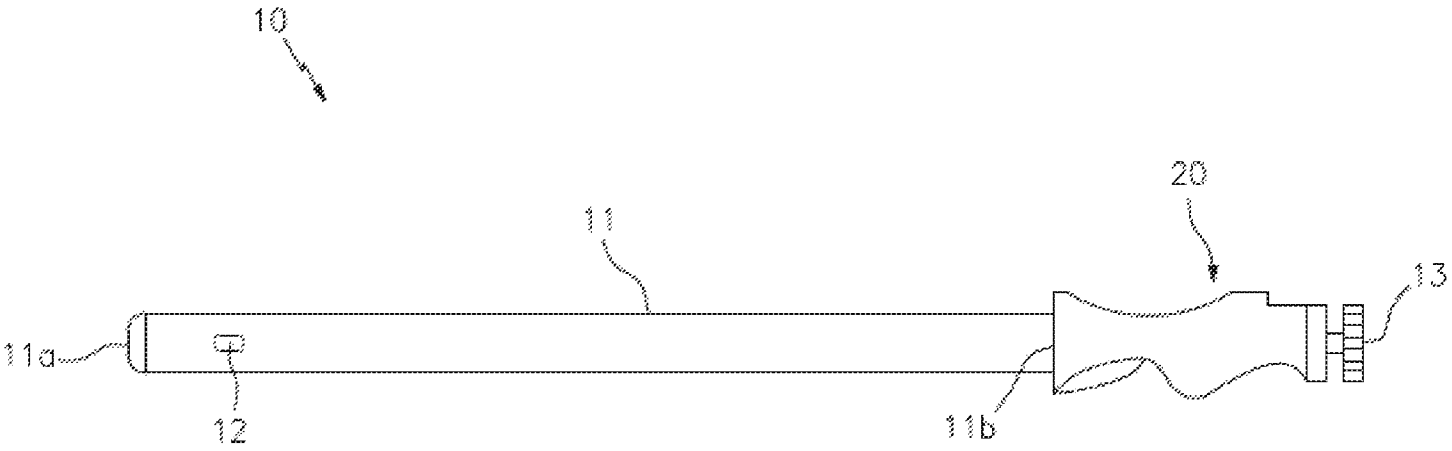
FIG. 1 is a side view of the drain wand that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As will be known to those of skill in the art, modern floor drains are typically constructed from plastic/PVC tubular members having a protective cover/grate secured along a top end. The grates typically include a plurality of openings that are at least ¼ inch in diameter, so as to allow water and other such material to easily pass into the drain body. Although described throughout this document as being utilized with a building floor drain, the inventive concepts disclosed herein are not to be construed as limiting to any particular use or field of endeavor.

Through extensive research and development, the inventor has discovered that a controlled discharge of water from a sprayer at approximately 125 psi impacting a plastic floor drain member at a distance of between 1 and 6 inches from the sprayer will function to dislodge accumulated drain material from the drain wall. Additionally, when the water impacts the drain wall at this pressure, there is not sufficient force to eject the material up, through the drain grate, and out of the drain body. Finally, repeated tests have shown that water sprayed at 125 psi does not have sufficient force to crack or otherwise damage existing floor drains. As such, the drain can repeatedly be cleaned at this pressure without risk of long term damage.

Figure 2:
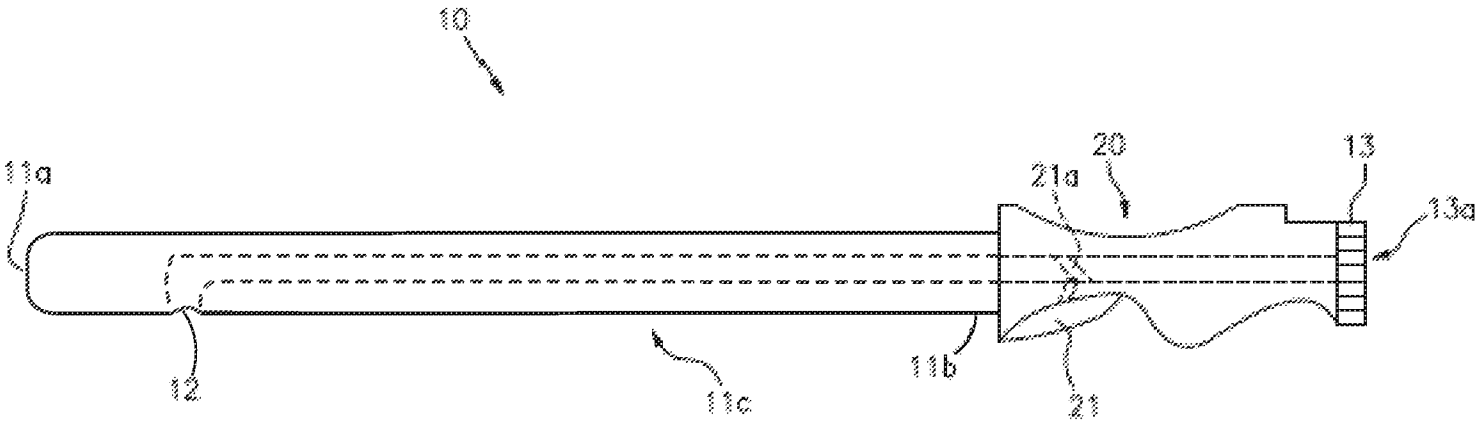
FIG. 2 is another side view of the drain wand, in accordance with one embodiment of the invention.

With this in mind, FIGS. 1 and 2 illustrate one embodiment of a drain wand 10 that is useful for understanding the inventive concepts disclosed herein. As shown, the device 10 can include an elongated wand body 11, having a sprayer 12, a water inlet unit 13, and a control handle 20.

The wand body 11 can function as a hand held device that can pass through the openings in a drain grate, in order to spray water at a specified pressure into the building drain. In this regard, the wand 11 can include an elongated, generally hollow tubular member that is constructed from a rigid material such as steel, for example. In one embodiment, the wand body can include a generally blunt distal end 11*a* which can function, if necessary, to break up any clumps or large accumulation of undesirable material within the drain body.

A sprayer 12 can be disposed along the wand body at a location that is adjacent to the distal end 11*a*. The sprayer can be connected to the proximal end of the wand 11*b* via an internal channel 11*c*, and can function to disperse water laterally from the wand.

In the preferred embodiment, the wand body 11 can be constructed from a steel rod having a length of between approximately 24 and 36 inches, and an outside diameter of approximately ¼ inch. Likewise, the sprayer can include a single elongated aperture having a length of approximately ½ inches that is positioned longitudinally along the wand body at a location that is approximately 1 inch from the distal tip 11*a*. The combination of the steel rod and the single aperture being sufficient to produce a lateral spray (i.e., perpendicular to the direction of the wand body) of approximately ½ inches and at a pressure of approximately 125 psi when secured to the buildings' commercial water supply.

Although described above as including a specific construction material and/or dimension, other materials, shapes and sizes are also contemplated. Moreover, the sprayer 12 can also include any number of distinct openings, having any number of sizes and locations along the wand body so as to create a controlled discharge of water at a desired pressure. To this end, although 125 psi is the optimum output pressure, other pressures ranging from approximately 75 psi to 175 psi are also contemplated. Such pressures can allow the device to compensate for different types of water supplies which may be at various pressures from the spigot.

A water inlet unit 13 can function to connect the device to a water source. To this end, the inlet unit 13 can be positioned along the proximal end of the wand 11*b* and can be configured to mate with a conventional water hose (not shown) via the plurality of threaded grooves 13*a* imprinted on an inside portion thereof. In this manner, the inlet unit can function to receive water from the buildings water source and direct the same into the device via the internal channel 11*c*. Of course, the device can be connected to any number of other types of water sources, and can also include other forms of connectors for engaging water supply lines, as are known in the art.

In one embodiment, the device can further include a control handle 20 which can act as a grip and controller for selectively engaging and disengaging the sprayer output. In one preferred embodiment, the control handle can be positioned along the proximal end of the wand body 11*b* at a location that is adjacent to the inlet unit 13. As shown, the control handle 20 can include a trigger 21, or other such mechanism, that is connected to a valve 21*a* that is capable of regulating the amount of water flowing through the internal channel 11*c*.

Figure 3:
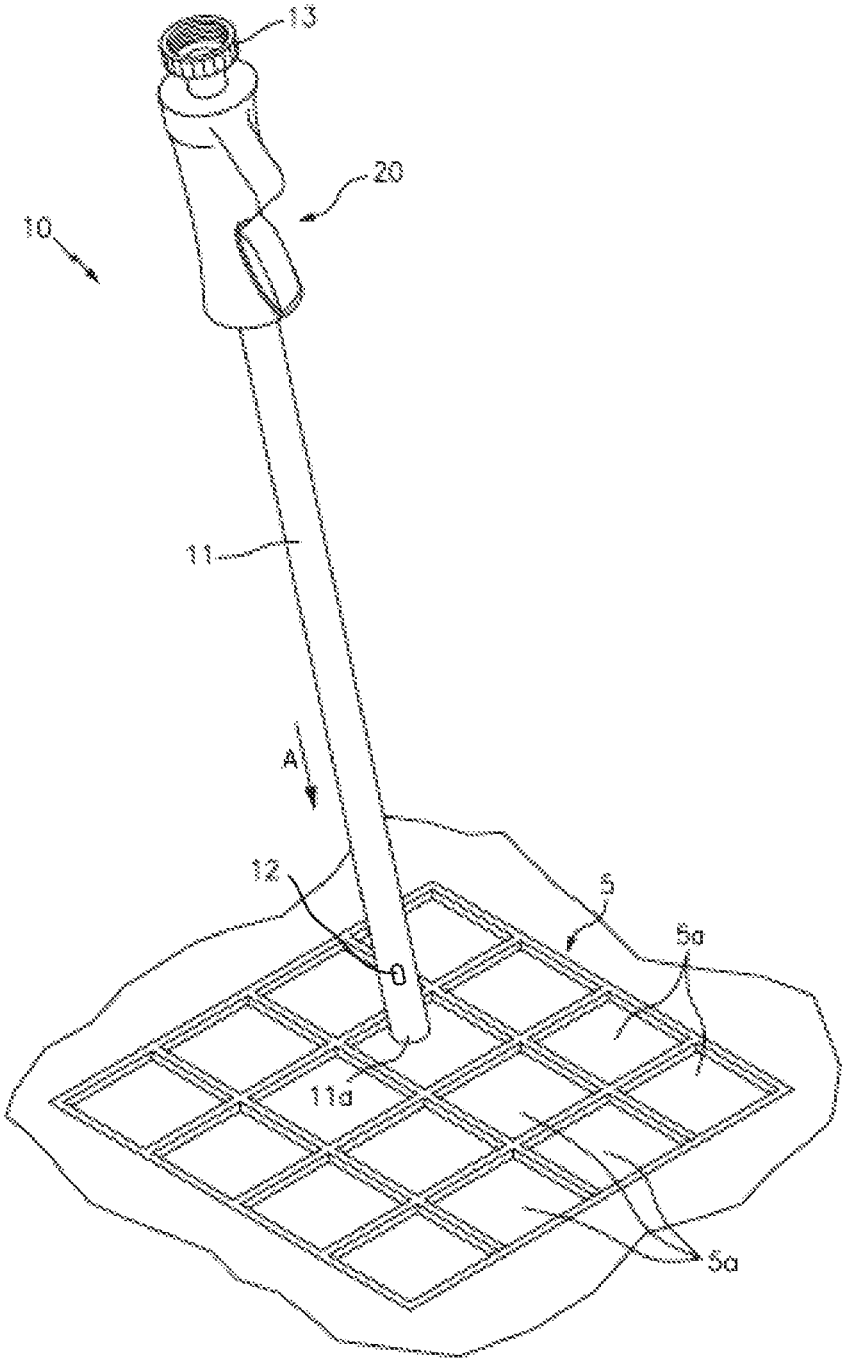
FIG. 3 is a perspective view of the drain wand in operation, in accordance with one embodiment of the invention.
Figure 4:
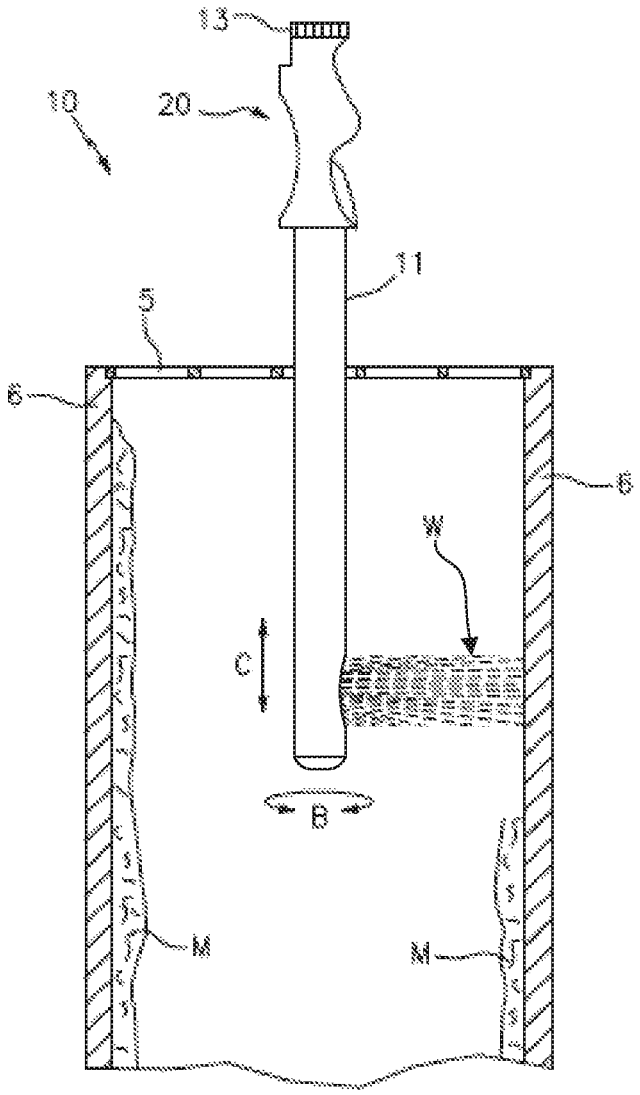
FIG. 4 is a side view of the drain wand in operation, in accordance with one embodiment of the invention.

FIGS. 3 and 4 illustrate one embodiment of the device 10 in operation. As shown, the wand body 11 can be positioned through any of the openings 5*a* of a floor drain grate 5 (see arrow A). When so positioned, the distal end 11*a* can be centered within the drain body 6, and the sprayer 12 can be activated via the controller 20. At this time, water W leaving the sprayer can be discharged laterally from the wand body and can impart the drain body at approximately 125 psi. This pressure being sufficient to dislodge any accumulated material M from the drain body. Next, the wand can be rotated 360 degrees (see arrow B) to clean all around the drain 6, and can be raised and lowered (see arrow C) until the entire drain has been cleaned.

Accordingly, by utilizing the above described drain wand, a user can quickly and easily clean floor drains without causing damage to the drain body, and without splashing the offending materials up and out of the drain itself.

As described herein, one or more elements of the drain wand device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements may be formed together as a single component, either through manufacturing processes, such as welding, casting, or molding, or through the use of a singular piece of material milled or machined with the aforementioned components forming identifiable sections thereof.

As described herein, one or more elements of the drain wand device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements such as the lower cabinet area 11, the countertop 12, the sink 13, and/or backsplash 16, for example, may be formed together as one continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A drain wand device, consisting of:

a single elongated rigid wand body having a distal end, a proximal end, an internal channel and a uniform shape along an entirety thereof, wherein the wand body includes a length of between 12 and 36 inches, and is constructed from a single steel rod having a uniform outside diameter of ¼ inches;

an inlet unit disposed along the proximal end of the wand body, said inlet unit being in communication with a first end of the internal channel, and including a connector that is configured to be removably connected to a water source;

a single sprayer that is positioned transversely within the single elongated rigid wand body at a location between the distal end and the proximal end, said sprayer being in communication with a second end of the internal channel and functioning to discharge water received by the inlet unit in a lateral and non-circular pattern from only one side of the single wand body; and a control unit that is affixed to the inlet unit and is in communication with the internal channel, said control unit including a handle having a trigger that is connected to an internal valve for regulating a flow of the water received by the water source.

* * * * *